United States Patent [19]

Hermanson

[11] Patent Number: 4,934,394

[45] Date of Patent: Jun. 19, 1990

[54] UMBRELLA WITH HOLLOW STAFF AND SPRING INFLUENCED CANOPY CHORDS

[76] Inventor: Terry Hermanson, 41 Madison Ave., New York, N.Y. 10010

[21] Appl. No.: 441,961

[22] Filed: Nov. 28, 1989

[51] Int. Cl.[5] ..... A45B 19/00

[52] U.S. Cl. ..... 135/195; 135/38; 135/25 R

[58] Field of Search ..... 135/19.5, 21, 28, 20 R, 135/37, 38, 40, 23, 98, 99, 25 R

[56] References Cited

U.S. PATENT DOCUMENTS

| | | | |
|---|---|---|---|
| 1,484,367 | 2/1924 | Vincent | 135/19.5 X |
| 1,769,315 | 7/1930 | Schoenhard | 135/20 X |
| 2,241,389 | 5/1941 | Berman | 135/19.5 |
| 2,465,140 | 3/1949 | Vila | 135/20 R X |
| 2,479,250 | 8/1949 | Mote | 135/37 X |
| 3,486,514 | 12/1969 | Prescott | 135/20 R X |
| 3,683,948 | 8/1972 | Cohen | 135/20 R |
| 3,765,433 | 10/1973 | Futamura et al. | 135/19.5 X |
| 4,062,369 | 12/1977 | Hermanson | 135/19.5 |
| 4,624,275 | 11/1986 | Baldwin | 135/19.5 |
| 4,842,003 | 6/1989 | Baldwin et al. | 135/19.5 |

FOREIGN PATENT DOCUMENTS

| | | | |
|---|---|---|---|
| 557574 | 6/1957 | Belgium | 135/20 R |
| 62296 | 5/1892 | Fed. Rep. of Germany | 135/19.5 |
| 834914 | 12/1938 | France | 135/20 R |
| 956087 | 4/1964 | United Kingdom | 135/20 R |

*Primary Examiner*—Henry E. Raduazo
*Assistant Examiner*—Lan Mai
*Attorney, Agent, or Firm*—Karl W. Flocks

[57] ABSTRACT

An umbrella comprising a staff, a canopy, and chords having their outer ends secured to the canopy margin and their inner ends slidable on the staff and being under the influence of a spring while the canopy is moved from folded position to open position and wherein the canopy is under tension when it is open and wherein the canopy, the chords, and a portion of the staff form a stabilizing triangular structure when the canopy is open.

8 Claims, 2 Drawing Sheets

UMBRELLA WITH HOLLOW STAFF AND SPRING INFLUENCED CANOPY CHORDS

This invention relates to umbrella structure and, more particularly, to a ribless umbrella with spring influenced chords that permit the umbrella to partially or fully close at a time when it is open and pointed into a strong wind and for maintaining the umbrella canopy under tension when the umbrella is open and a guiding element for controlling the innermost ends of the chords when the umbrella is almost or completely closed.

BACKGROUND

Prior to the instant invention umbrellas have included structure comprising canopies which are principally supported by ribs butressed by hinged chords. Prior attempts to eliminate the ribs have resulted in generally unsatisfactory umbrella constructions which fail or inadequately serve the user confronted with the necessity of opening and closing the umbrella and to protect the user in times of inclement weather. Prior umbrella constructions are depicted in the following U.S. Patents to Wilson, U.S. Pat. No. 3,186,421; Spiro, U.S. Pat. No. 1,833,004; and dePolo, U.S. Pat. No. 4,084,600; as well as the Russian Patent No. 479468 and the French Patent to Alan Philip Sasseen No. 2,403,760.

It is to be desired that umbrellas protect users under windy conditions. Wind can strike an umbrella from any direction. Most winds which affect an umbrella come down on the open umbrella canopy or blow up against the underside of the open canopy.

Traditional umbrellas comprising canopies which are principally supported by flexible ribs extending radially from the staff at their inner ends to the outer margin of the canopy at their outer ends which ribs are each buttressed at an intermediate location along its length by a hinged link or chord which serves to make the innermost portions of the rib rigid and leave the outermost portion of the rib flexible. Such prior constructions are prone to having the canopy turned inside out during an updraft. The triangulation afforded by the buttressing hinged link or chord does not extend to the margin of the canopy. Also, because the inner part of the canopy is buttressed while the outer part is not, the umbrella canopy when open has limited flexibility in the face of a down draft which may cause the umbrella frame to break or the canopy fabric to tear away from the frame.

Prior umbrellas which utilize a series of chords which extend from the staff to the outer margin of the canopy and no ribs are either so rigid that the fabric will tear away from the frame in a heavy wind unless additional cables so the like are installed in the hem or peripheral margin of the canopy or of such construction which lacks the quality of desired protection as heretofore described.

In accordance with the instant invention, the construction is such that the canopy frame is relatively rigid when faced with an updraft and triangulation extends from the staff all the way outwardly to the margin of the canopy. A stop limits the angle of the chords so as to keep an updraft from turning the canopy inside out. In a down draft, the canopy frame is all flexible and a strong down draft will close the umbrella insuring that the fabric will not tear from the frame.

It is an object of the instant invention to provide a strong, stable, ribless construction in which the conventional ribs that normally support the canopy are omitted and wherein radial chords influenced by spring pressure serve to maintain the canopy under tension and wherein guide means are provided to control the inner ends of the chords when the umbrella is almost or completely closed.

Other objects and the nature and advantages of the invention will become apparent from the following description and exposition taken with the accompanying drawings.

DETAILED DESCRIPTION

Figure 1:
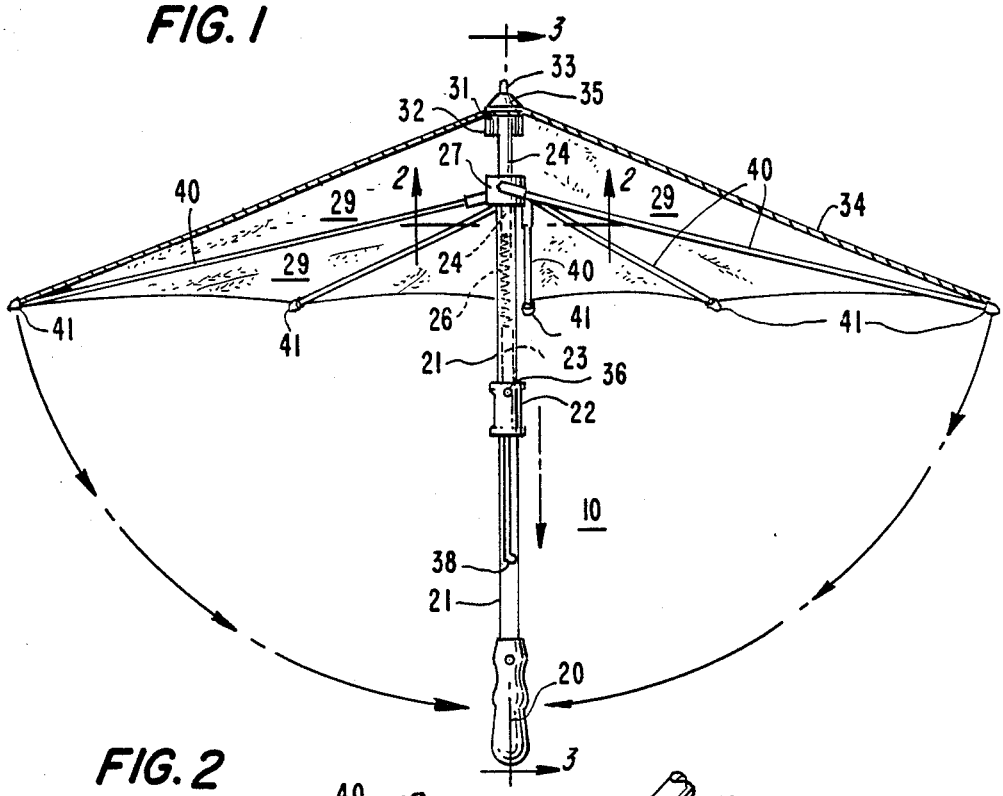
FIG. 1 is a side elevation of the umbrella in accordance with the invention when it is open with parts shown in section.

Referring to the drawings, and more particularly to FIGS. 1, 2, 3, 3A, 4, and 5, the umbrella 10 includes a handle 20 to which is secured the hollow cylindrical staff 21. Slidably associated about the staff 20 is the operating ring 22.

A first telescoping member 23 is located within the lower portion of the hollow cylindrical staff 21. A second telescoping member 24 is located partially in the upper portion of the hollow cylindrical staff 21 and partially externally thereof and thereabove when the umbrella is open. The second telescoping member 24 is entirely within the hollow cylindrical staff 21 when the umbrella is closed, as illustrated in FIG. 4.

Figure 3:
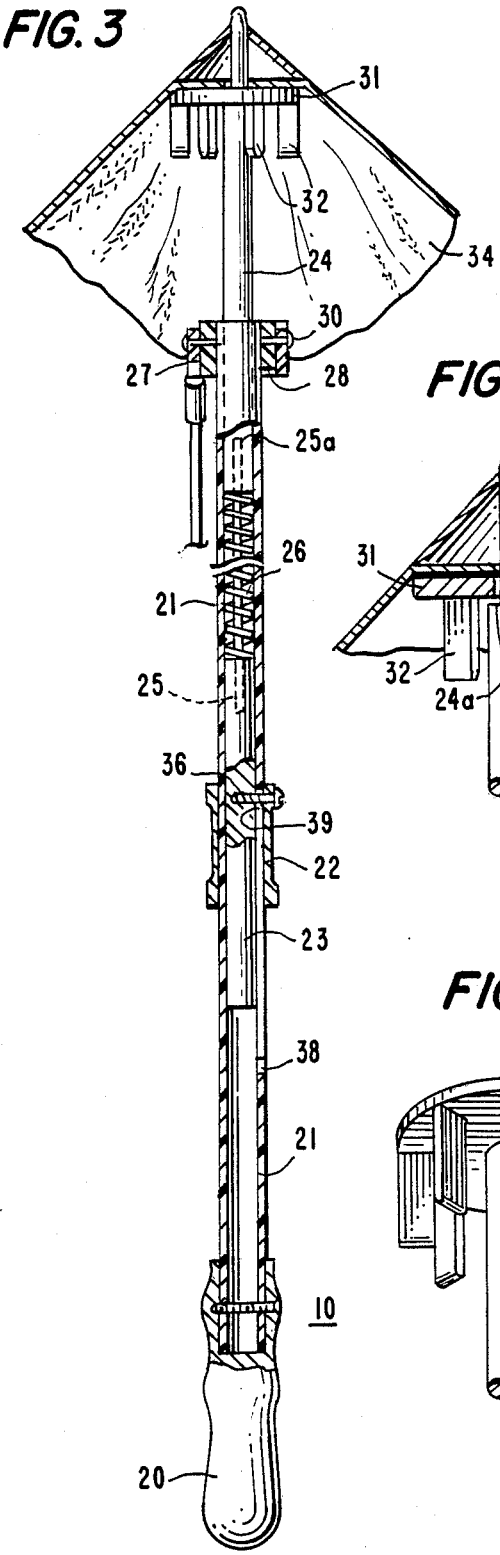
FIG. 3 is generally taken along line 3—3 of FIG. 1, looking in the direction of the arrows and is in part in elevation with parts shown in section and with parts broken away and enlarged in relation to FIG. 1 showing the mechanism when the umbrella is in open position.

Helical compression spring 26 located within the hollow cylindrical staff 21 between the first telescoping member 23 and the second telescoping member 24 is concentric to the guide rod 25, as illustrated in FIG. 3. The lower end of the guide rod 25 is embedded in the first telescoping member 23. The lower end of the second telescoping member 24 is formed with an extended cylindrical cavity **25*a* to receive the upper end of the guide rod 25 and within which cavity 25*a* the upper end of the guide rod 25 may slide when the first telescoping member 23 is moved upwardly and the spring 26** is compressed.

Mounted about the upper end of the hollow cylindrical staff 21 is the pinwheel mounting member 27 as best shown in FIG. 3. The pinwheel mounting member 27 is formed with bearings 28 with which the inner ends of chords 29 may be associated by the utilization of pins 30.

Figure 3A:
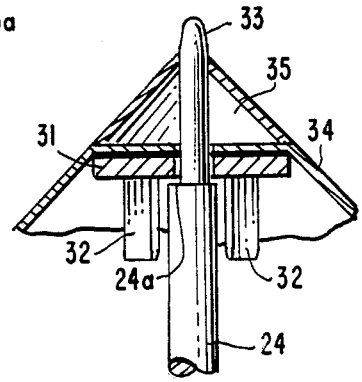
FIG. 3A is a fragmentary vertical section with parts shown in elevation of the upper portion of the umbrella staff and its relation, to the rotatable guide fixture and the cap above the uppermost portion of the canopy.
Figure 4:
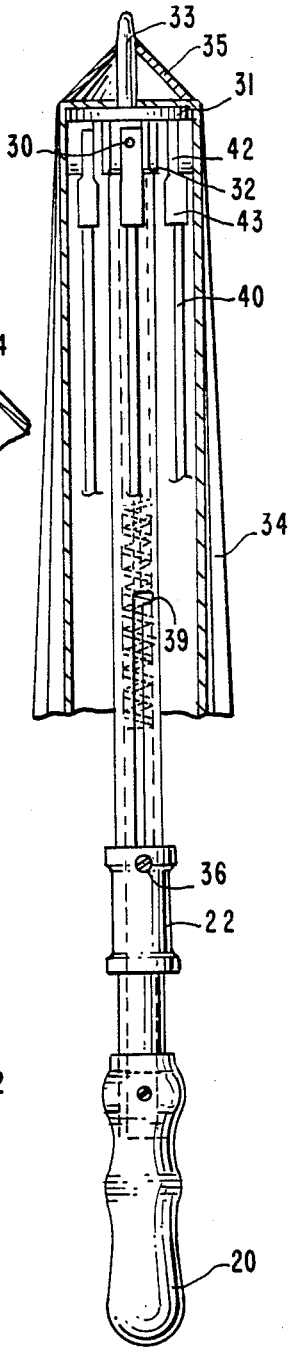
FIG. 4 is an end elevation with parts shown in section on the scale of the FIG. 3 and showing the umbrella in closed position and FIG. 5 is a view in perspective of the rotatable guide fixture in association with a portion of the uppermost telescopic staff member.
Figure 5:
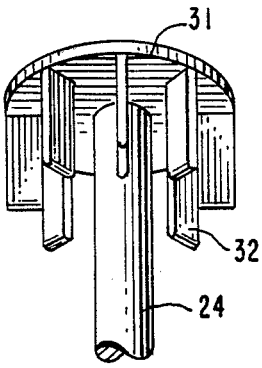

The rotatable guide fixture 31 shown in perspective in FIG. 5 and in elevation in FIG. 3 and in cross-section in FIG. 3*a*, which serves to stabilize the inner ends of the chords 29 when the umbrella 10 is almost or completely closed, as illustrated in FIG. 4.

The uppermost portion of the second telescoping member 24 is formed with an upwardly extended extension 33 which is of lesser diameter than the diameter of the second telescoping member 24 so as to provide a shoulder 24*a* to support the rotatable guide fixture 31 which is immediately below and in contact with the umbrella canopy 34. Surrounding the vertically extending second telescoping member extension 33 is the generally conical centrally bored cap 35.

The hollow cylindrical staff 21 is formed with a vertical slot 37, as shown in FIGS. 1, 3, and 4 and is provided with a lower offset 38, as illustrated in FIG. 1, and an upper offset 39, as illustrated in FIGS. 3 and 4. Slidable ring 22 is provided with a screw 36, which rides in the slot 37.

Figure 2:
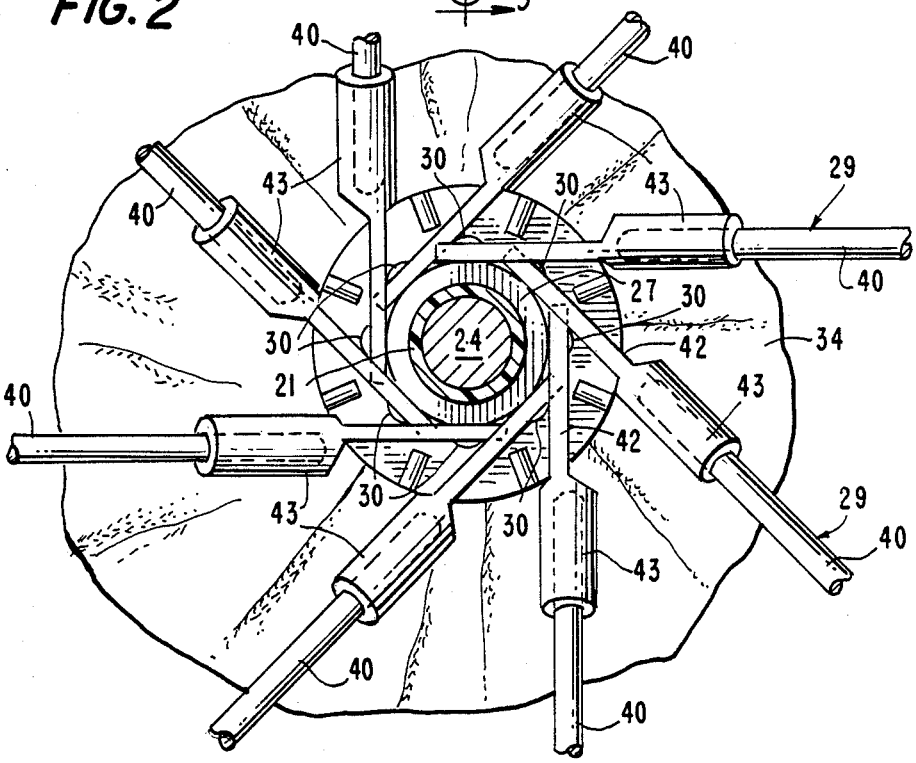
FIG. 2 is an enlarged fragment of a section taken along line 2—2 of FIG. 1 and looking in the direction of the arrows.

Chords 29 may consist of relatively rigid rods 40, first fittings 41 for securing the canopy margin and second fittings 42, see FIG. 2, which, at their inner ends include sockets 43 to receive the inner ends of rods 40. Said sockets are provided at their inner ends with pierced bearing formations 28 through which the pins 30 extend so that the chords 29 are mounted in pinwheel fashion about the pinwheel mounting member 27 in such manner that they may rotate from vertical position shown in FIG. 4 when the umbrella is closed to almost a horizontal position as shown in FIG., 1 when the umbrella is open.

In FIG. 1, the chords 29 are shown with their outer ends attached to the canopy just below the level of the pinwheel mounting member 27. FIG. 1 illustrates the function of the chords 29 to be structurally supporting as a main base horizontal member is in a truss, with the canopy 34 as an upper member under tension associated at its uppermost portion with the top of the freely rotatable guide fixture 31. The vertical second telescoping member 24 is a third element of the triangular structure, as illustrated in FIG. 1. Thus, the chords 29, the member 24, and the canopy 34 form a triangle regarded as a stable structure.

When the umbrella is open the canopy 34 is in tension and the inner ends of the chords are locked in place by reason of the offset 39 which locks the operating ring 22 in its uppermost position and is under the influence of the compression spring 26.

The umbrella 10, in accordance with the invention, may be of small size or large size and the staff 21 may be relatively long. One example of the extended staff, as illustrated in FIG. 3, including the handle 30 may be about 26 inches in height When the umbrella of this example is open as illustrated in FIG. 3, the distance between the pinwheel mounting member 27 and the rotatable guide fixture 31 may be in the order of three and a half inches, more or less, and the spring 26, under compression, may have an axial length of five inches, more or less. In this example, the distance between the offset 38 and the offset 39 may be approximately four and a half inches, more or less. Also, when the umbrella is closed and the operating ring 22 is in the position corresponding to offset 38, the spring 26 may have an axial length of about six inches, more or less, as it will be understood that this compression spring has been at least partially, if not entirely, released or free.

In operation one starts with a closed umbrella, as illustrated in FIG. 4, with one hand of the user on the handle 20 and the other hand on the operating ring 22. A slight twist will release the operating handle 22 which then may be slidably moved upwardly with the screw 36 riding in the slot 37. As the screw 36 is fixed to the first telescoping member 23, it will be moved upwardly to compress the spring 26 and, at the same time, force the second telescoping member 24 to move upwardly so that the rotatable guide fixture 31 which supports the canopy 34 will be moved upwardly to the position shown in FIG. 3 and also in FIG. 1. As the outer ends of the canopy 34 are secured to the chords 29, they will be moved upwardly to a level almost as high as the operating ring 22. The operating ring 22 completes its upward movement when it is rotated slightly to the right so that the screw 36 is locked in the offset 39. In this position the roof of the canopy is being forced upwardly so that canopy 34 is under tension, the chords are almost horizontal and the inner ends of the chords are locked and under the influence of the compression spring 26. In this position the umbrella 10 protects the user from inclement weather and also from the sun, when shade is desired The umbrella is closed by rotating the operating ring 22 slightly to the left so that the screw 36 may descend in the slot 37 and by rotation of the ring 22 slightly to the right, the screw 36 may be locked in the offset 38. In this position the compression spring 26 will be partially if not completely released, the canopy will no longer be under tension. The chords 39 will be rotated in the direction shown by the arrows in FIG. 1 to take the position shown in FIG. 4. When the umbrella is almost or completely closed, the upper ends of the chords 29 including fittings 42 will be guided and stabilized by the guide fingers 32 of the freely rotatable guide fixture 31.

As an alternative construction instead of utilizing a helical compression spring within the hollow staff, individual compression springs may be provided on the interior of the chords 29 which may be of telescopic construction as described above in connection with the staff.

Although preferred embodiments have been described, it is apparent that changes and modifications can be made and equivalents substituted without departing from the invention.

What is claimed is:

1. In an umbrella having a canopy, a which has an outer margin and a central portion canopy supporting structure, and mechanism for opening said canopy, a slotted hollow staff, a slidable operating ring surrounding said hollow staff, a first telescoping member, a compression spring having opposed ends a second telescoping member supporting the center of the canopy a plurality of chords, having inner ends and outer ends a mounting member for pivotally securing the inner ends of said chords, means for securing said slidable operating ring through the slot of said staff to said first telescoping member, said first telescoping member having a first end engaging with said spring which is in engagement at said second end with said second telescoping member, the outer margin of said canopy being secured to the outer ends of the chords, whereby when the umbrella is in closed position and it is desired to open the umbrella, the slidable operating ring is moved upwardly to cause the first telescoping member to compress the spring which causes the second telescoping member to move upwardly and raise the center of the canopy and place it in tension and in turn causes the outer margin of the canopy to raise the outer ends of the chords, so that the canopy under tension, the chords, and the second telescoping member form a strong and stable triangular supporting structure.

2. An umbrella in accordance with claim 1, said mechanism including a guide rod having opposed ends extended longitudinally through said compression spring and fixed to said first telescoping member at one of its ends, said second telescoping member being formed with an extended cylindrical cavity into which the opposite end of said guide rod is movable.

3. An umbrella in accordance with claim 1 wherein said mounting member is generally polygonal having facets on which the inner ends of said chords are pivotally supported.

4. An umbrella in accordance with claim 1, the upper portion of said second telescoping member being formed with a shoulder and vertical extension, said shoulder having threaded thereabove the central portion of said canopy, a cap threaded on said extension in finishing association with said vertical extension and the central portion of said canopy.

5. An umbrella in accordance with claim 4, said mechanism including a rotatable guide fixture provided with spaced guide fingers for stabilizing the pivotally mounted inner ends of said chords when the umbrella is almost or completely closed

6. An umbrella in accordance with claim 5, said mounting member for pivotally securing the inner ends of said chords being fixed to the upper end of said hollow staff, said rotatable guide fixture resting on the shoulder at the base of the second telescoping member extension, the central portion of said canopy resting on the top of said rotatable guide fixture and said cap located in finishing relation to said second telescoping member extension and the central portion of said canopy.

7. An umbrella in accordance with claim 6 wherein the slot in said hollow staff has an upper offset spaced from a lower offset, said means for securing said slidable operating ring through the slot of said hollow staff to said first telescoping member being so shaped as to ride in said slot with facility in sliding relation and being movable to said upper offset to lock said umbrella in open position and movable to said lower offset to lock said umbrella in closed position whereby when the umbrella is in open position and it is desired to close the umbrella, the slidable operating ring is moved downwardly to partially release or free said compression spring which causes the second telescoping member to move downwardly so that the central portion of the canopy is lowered and its tension released which causes the outer margin of the canopy to be lowered and the chords rotated to vertical position so that the inner ends of the chord assume a final path guided by the rotatable guide fixture fingers and the lowered canopy assumes a draped position about the downwardly folded chords which surround the umbrella staff.

8. In an umbrella having a canopy, a canopy supporting structure, and mechanism for opening said canopy, a slotted staff, a slidable operating ring surrounding said staff, a plurality of chords, a mounting member for pivotally securing the inner ends of said chords, means for securing said slidable operating ring through the slot of said staff, the outer margin of said canopy being secured to the outer ends of the chords, spring means associated with said mechanism influencing opening said canopy and for exerting pressure on said chords for maintaining the canopy under tension, whereby when the umbrella is in closed position and it is desired to open the umbrella, the slidable operating ring is moved upwardly to compress said spring means and to raise the center of the canopy under tension, so that the canopy under tension, the chords, and at least a portion of the staff form a strong and stable triangular supporting structure.

* * * * *